US007118106B1

(12) United States Patent
Meyer et al.

(10) Patent No.: US 7,118,106 B1
(45) Date of Patent: Oct. 10, 2006

(54) PORTABLE TOY AND GAME DEVICE

(76) Inventors: Steven W. Meyer, 166 S. Wardsboro Rd., P.O. Box 404, Newfane, VT (US) 05345; Karren E. Meyer, 166 S. Wardsboro Rd., P.O. Box 404, Newfane, VT (US) 05345

( * ) Notice: Subject to any disclaimer, the term of this patent is extended or adjusted under 35 U.S.C. 154(b) by 151 days.

(21) Appl. No.: 10/775,384

(22) Filed: Feb. 10, 2004

Related U.S. Application Data

(60) Provisional application No. 60/446,158, filed on Feb. 10, 2003.

(51) Int. Cl.
*A63F 11/00* (2006.01)

(52) U.S. Cl. ..... 273/148 R; 273/459

(58) Field of Classification Search ..... 273/440, 273/459, 148 R, 159, DIG. 26; 40/625, 40/632, 633; 116/222, 225; 63/3, 38–40
See application file for complete search history.

(56) References Cited

U.S. PATENT DOCUMENTS 4,132,187 A * 1/1979 Moebius ..... 116/225
4,158,342 A * 6/1979 Scruggs ..... 116/225
5,023,956 A * 6/1991 Fox ..... 2/338
6,234,918 B1 * 5/2001 Nally et al. ..... 473/473
6,747,917 B1 * 6/2004 Jennings et al. ..... 368/10
D497,826 S * 11/2004 Nelson ..... D11/3

* cited by examiner

*Primary Examiner*—Raleigh W. Chiu
(74) *Attorney, Agent, or Firm*—Downs Rachlin Martin PLLC

(57) ABSTRACT

A device (20, 301–306, 501–503, 566, 700) for playing "spotting type" games. In one embodiment, the device includes an elongate member (24) having visible thereon two sets (36, 40) of indicia (44, 48), wherein the indicia in each set are spaced apart along the length of the member and the sets are spaced apart around the circumference of the member. A spotter 28 having an indicator 92 is movable along the member to allow the user to move the indicator to ones of the indicia as needed to play the game. A game may be played by reading one of the indicia, spotting an item corresponding to the indicia and then moving the spotter so that the indicator indicates that indicia.

20 Claims, 13 Drawing Sheets

FIG. 4

7/13

TABLE 1

ALPHABET 112

36

| | | | | | | | | | | | | |
|---|---|---|---|---|---|---|---|---|---|---|---|---|
| R | B | N | V | X | I | S | Y | T | W | U | F | D |
| Q | A | O | H | E | M | K | P | Z | J | G | L | C |

40

TABLE 2

PASSENGER VEHICLES 112

36

| | | | | | | | | | | | |
|---|---|---|---|---|---|---|---|---|---|---|---|
| red | green | silver | black | white | tan | green | black | yellow | red | blue | orange |
| tan | white | yellow | grey | blue | red | silver | brown | orange | tan | white | grey |

40

TABLE 3

VEHICLES AND THEIR COLORS 112

36

| | | | | | | | | | | | |
|---|---|---|---|---|---|---|---|---|---|---|---|
| red car | green SUV | silver van | black pickup | white car | tan car | green van | black SUV | yellow car | red pickup | blue van | orange ~~pickup~~ SUV |
| tan car | white SUV | yellow van | grey pickup | blue car | red car | silver van | brown SUV | orange car | tan pickup | white van | grey SUV |

40

TABLE 4

CONSTRUCTION TRUCKS 112

36

| | | | | | | | | |
|---|---|---|---|---|---|---|---|---|
| grader | bucket loader | dump truck | bulldozer | excavator | backhoe | paver | roller | scraper |
| bulldozer | scraper | grader | paver | backhoe | roller | bucket loader | excavator | dump truck |

40

TABLE 5

JUST STUFF YOU SEE 112

36

| | | | | | | | | |
|---|---|---|---|---|---|---|---|---|
| Bridge | House Trailer | Junk Car | Airplane | Dog | Orchard | Boat | Pond | ATM Machine |
| Trash Can | Fence | Bicycle | Telephone | River | Barn | Office Building | Church | Playground |

40

TABLE 6

50

SIGNS YOU SEE 112

35

36

| | | | | | | | | | |
|---|---|---|---|---|---|---|---|---|---|
| STOP | FOR SALE | REST AREA | RESTAURANT | GAS | MOTEL | YIELD | 65 | HOSPITAL | SCHOOL |
| GIFTS | CAUTION | SLOW | ANTIQUES | EXIT | SOUVENIRS | NO U TURN | AIRPORT | TRUCK STOP | 55 |

40

FIG. 4 (cont'd)

TABLE 7.

MORE JUST STUFF YOU SEE 112 36

| | | | | | | | | |
|---|---|---|---|---|---|---|---|---|
| Cemetary | Parking Meter | Fire Truck | Bus Stop | Dumpster | Oil Truck | Boat | Camper | 18 Wheeler |
| Swing Set | Tower | Gas Station | Tow Truck | Fountain | School Bus | USA Flag | Gate | police car |

40

TABLE 8

EVEN MORE JUST STUFF YOU SEE 112 36

| | | | | | | | | |
|---|---|---|---|---|---|---|---|---|
| Garbage Truck | Basketball Hoop | Cement Mixer | Fire Hydrant | Street Light | Junkyard | Yellow Sign | Garage | Guard Rail |
| Bus | RR Tracks | Mailbox | Stone Wall | Motorcycle | Red Roof | Garden | Silo | Utility Pole |

40

FIG. 4 (cont'd)
9/13

TABLE 9

HUMAN WASTE 112

36

| | | | | | | | | |
|---|---|---|---|---|---|---|---|---|
| Spray Can | Broken Bottle | Napkin | Liquor Bottle | Cardboard Box | Broken Window | Old Shoe | Cigarette Package | Bucket |
| Old Sock | Junk Car | Soda Can | Hub Cap | Coffee Cup | Plastic Utensil | Old Tire | Lottery Ticket | Candy Wrapper |

40

TABLE 10

HUMAN EXCESS too much... too many... 112

36

| | | | | | | | | |
|---|---|---|---|---|---|---|---|---|
| jewelry | talking | luggage | noise | hair | trash | pounds | toys | children |
| make Up | sun | alcohol | money | muscle | technology | piercings | drugs | snacks |

40

TABLE 11

WHAT WE WEAR 112

36

| | | | | | | | | |
|---|---|---|---|---|---|---|---|---|
| sun glasses | yellow shorts | pink shirt | black socks | logo T-shirt | hood | striped shirt | any uniform | plaid shirt |
| tie | black cap | white shoes | sandles | sweater | blue jeans | sweat shirt | gloves | leather jacket |

40

TABLE 12

AROUND HOME 112

36

| | | | | | | | | |
|---|---|---|---|---|---|---|---|---|
| teddy bear | family photo | grocery list | garbage can | country music | plant | rock music | newspaper | doll |
| phone | flowers | aspirin | atlas | broom | sports ball | biography | pet | luggage |

40

FIG. 7A (PLAN VIEW)
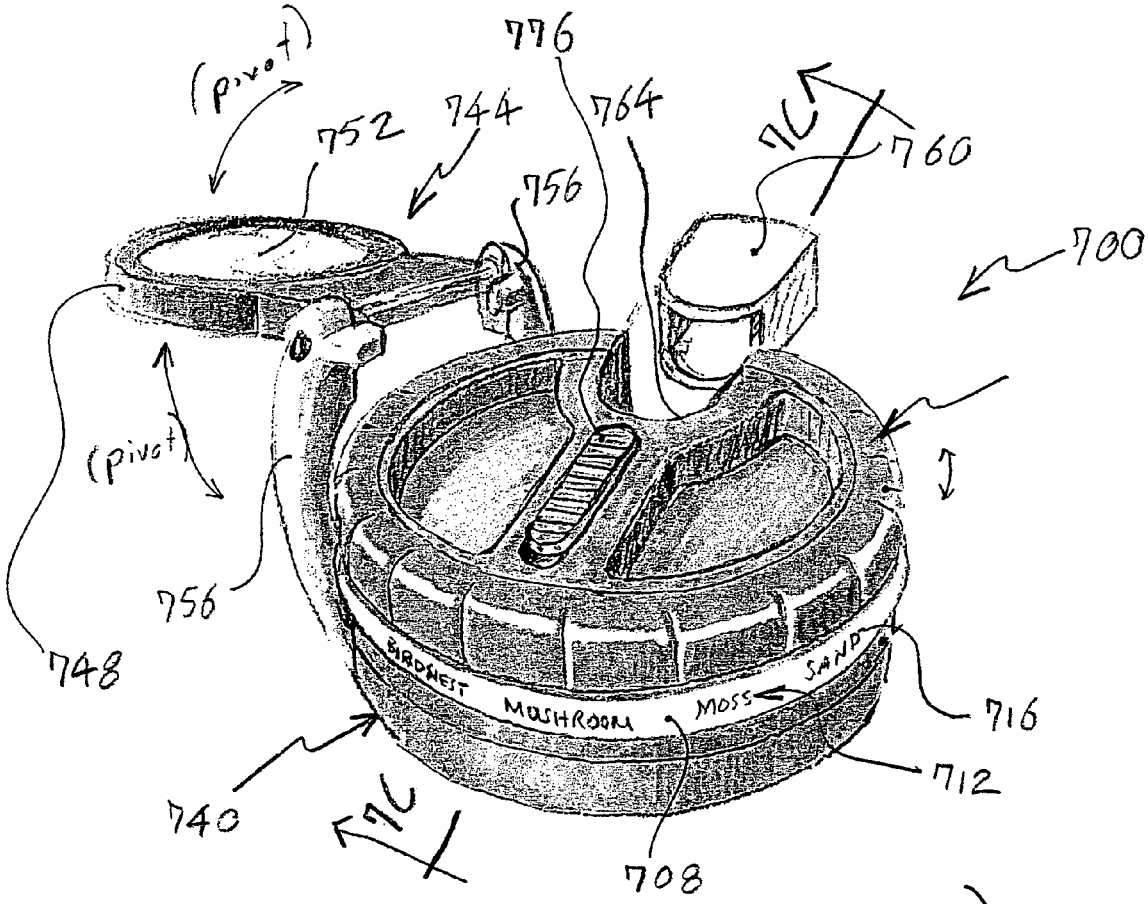
FIG. 7B (ELEVATIONAL VIEW)

PORTABLE TOY AND GAME DEVICE

RELATED APPLICATION DATA

This application claims the benefit of priority of U.S. Provisional Patent Application Ser. No. 60/446,158, filed Feb. 10, 2003, and titled "Portable Toy and Game Device," that is incorporated by reference herein in its entirety.

FIELD OF THE INVENTION

The present invention generally relates to the field of amusement devices. In particular, the present invention is directed to a portable toy and game device.

BACKGROUND OF THE INVENTION

Many people enjoy games. However, relatively few games are suitable for use in virtually any setting, e.g., travel, sightseeing, home, running errands around town, and neighborhood play, among many others. For example, traveling in an automobile can be boring and tedious, particularly to children. Parents often try to find ways to keep their children occupied and entertained in order to keep everyone in the automobile happy. Parents often prefer simple games, such as license plate spotting, "I spy" and other spotting games, that do not necessarily require any type of device for recording the items spotted and can be played for free. Children, on the other hand, often tend to prefer games that are played with various devices, e.g., boards, cards, and electronic devices, that they can handle. However, problems with such games are that they often require too much set up time, are too difficult to operate in an automobile or are too expensive. What is needed, therefore, are game devices that are desirable to the players, particularly children, but are simple to play and inexpensive. Such devices would tend to make both the parents and their children happy.

SUMMARY OF THE INVENTION

In one aspect, the present invention is directed to a device comprising an elongate resilient flexible member having a length and including at least a first set of indicia having a first plurality of indicia spaced from one another along the length. A spotter is engaged with the elongate resilient flexible member and movable so as to be positionable to indicate any selected one of the first plurality of indicia.

In another aspect, the present invention is directed to a device comprising a support. A member is removably engaged with the support and includes at least a first set of indicia having a first plurality of indicia spaced from one another. A spotter is engaged with the support and movable relative to the member so as to be positionable to indicate any selected one of the first plurality of indicia.

In yet another aspect, the present invention is directed to a system comprising a plurality of devices removably coupled with one another so as to form a daisy chain. Each device comprises an elongate member having a length and at least one set of indicia comprising a plurality of indicia spaced from one another along the length. At least one end connector is removably connected to a complementary end connector attached to the member of another one of the plurality of devices.

BRIEF DESCRIPTION OF THE DRAWINGS

For the purpose of illustrating the invention, the drawings show forms of the invention that are presently preferred. However, it should be understood that the present invention is not limited to the precise arrangements and instrumentalities shown in the drawings, wherein:

FIG. 4 shows tables illustrating various game themes and corresponding indicia that may be used with the device of FIG. 1A;

FIG. 7A is a partially-exploded plan view of an alternative device of the present invention; FIG. 7B is an elevational view of the device of FIG. 7A.

DETAILED DESCRIPTION OF THE DRAWINGS

Figure 1A:
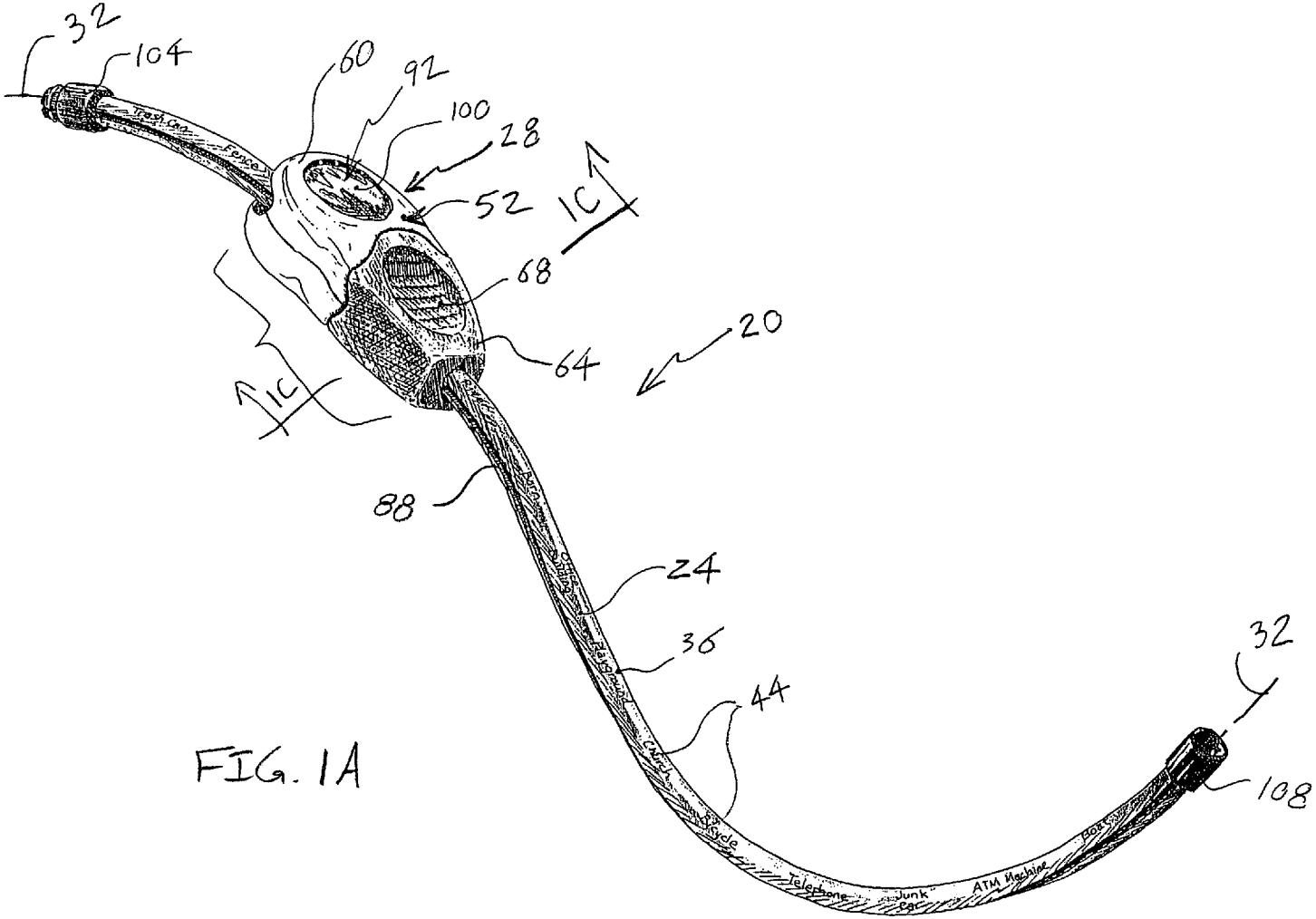
FIG. 1A is a perspective view of a device of the present invention.
Figure 1B:
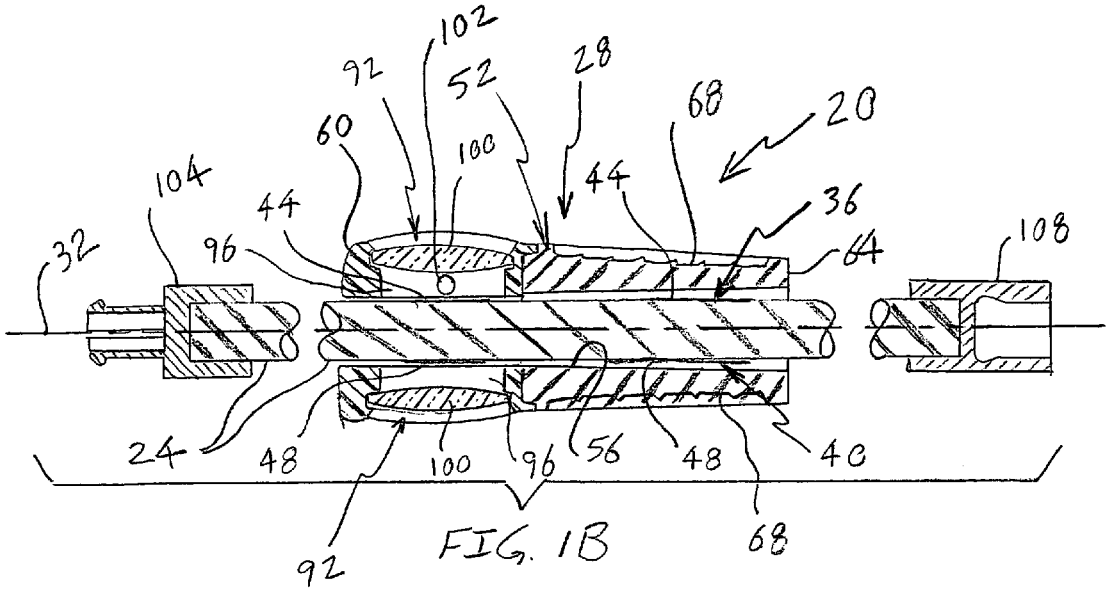
FIG. 1B is a longitudinal cross-sectional view of the device of FIG. 1A.
Figure 1C:
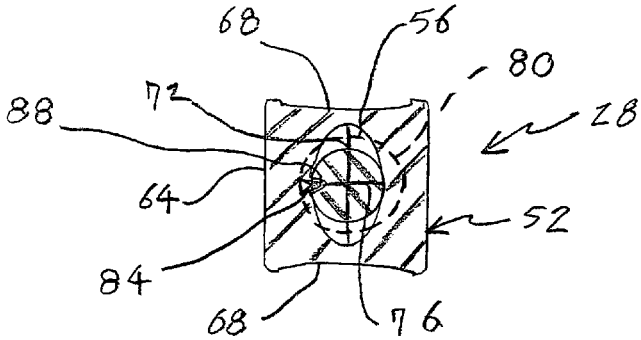
FIG. 1C is an enlarged cross-sectional view of the device of FIG. 1A as taken along the line 1C—1C.

Referring now to the drawings, FIGS. 1A–1C shows in accordance with the present invention a toy/game device, which is generally indicated by the numeral 20. Device 20 may comprise an elongate member 24 and a spotter 28 engaged with the member so as to be movable relative thereto in a direction along the longitudinal central axis 32 of the member. A user may use device 20, among other things, to play a "spotting" game, either alone or along with, e.g., in competition with, users of devices the same as or similar to device 20. In this connection, member 24 may include one or more sets 36, 40 of indicia 44, 48, each set corresponding to a set of items (not shown) that the user must spot in order to win the game. After the user spots an item, the user may move spotter 28 to the one of indicia 44, 48 corresponding to that item. Use of device 20 is described in greater detail below.

Member 24 may, but need not, be a resilient flexible member. As used herein and the claims appended hereto, the term "resilient flexible member" indicates that member 24, or portion thereof, may be repeatedly moved between a linear shape and the shape of an arc having a radius less than about one foot (30.5 cm), more preferably less than about 6 inches (15.2 cm), most preferably less than about 3 inches (7.6 cm), generally without damaging the member. Thus, although member 24 may be made of virtually any material desired, for a resilient flexible member embodiment, suitable materials include conventional resilient flexible materials, such as certain plastics and elastomers, among others. In other embodiments, e.g., wherein elongate member 24 is formed into a permanent ring shape, suitable materials are relatively rigid materials, such as generally low-flexibility polymers.

Member 24 may be any length desired, but in the most portable forms of the invention the length is typically less than about 13 inches (33.0 cm). Member 24 may have any cross-sectional shape desired, such as the generally circular cross-sectional shape shown. Other cross-sectional shapes include other arcuate cross-sectional shapes, such as oval or ellipsoidal, polygonal shapes, such as triangular and hexagonal, and combinations of the two, among others. Such cross-sectional shapes may be used for member 24 when the member is either solid or includes one or more longitudinal cavities (not shown), such as a tube having a single central longitudinal cavity.

Indicia 44, 48 may be provided to member 24 in any suitable manner, e.g., printing, painting, inlay, etching and molding, among others. Regarding indicia 44, 48 shown in FIGS. 1B and 1C, the indicia is depicted as being raised relative to the surface of member 24 for the convenience of illustrating suitable locations for the indicia. Of course, indicia 44, 48 need not be raised, but rather may be flush and/or recessed relative to the surface of member 24. Those skilled in the art will understand the variety of ways in which indicia 44, 48 may be provided to member 24. Therefore, it is not necessary to list all possible ways for those skilled in the art to understand the broad scope of the invention. As mentioned above, indicia 44, 48 are generally provided in one or more sets 36, 40. If multiple sets 36, 40 are provided, they may be located in spaced relation with one another, e.g., around the circumference of member 24. These sets 36, 40 are described below in more detail in connection with a description of games that a user can play with device 20.

Referring to FIG. 1A, and also to FIG. 1B, spotter 28 may be movably engaged with member 24 in any suitable manner. For example, spotter 28 may include a body 52 having a receiver 28, e.g., the generally central, longitudinal cavity 56 shown, that receives member 24. In this case, spotter 28 may be slidable along member 24 with a friction fit between body 52 and the member. For example, body 52 may include a relatively stiff, non-resilient portion 60 and a relatively flexible, resilient portion 64. When member 24 has a circular cross-sectional shape, the portion of cavity 56 in non-resilient portion may, but need not, likewise have a circular cross-sectional shape, but have an inside diameter that is at least slightly greater than the outside diameter of the member so that the member is substantially freely movable in this portion of the cavity.

Referring additionally to FIG. 1C, resilient portion 64 of body 52 may include a pair of finger grips 68 on opposite sides of the resilient portion that a user may use to compress the resilient portion so as to allow member 24 to move freely within the resilient portion. In this connection, at least a portion of cavity 56 in resilient portion 64 may have a generally elliptical transverse cross-sectional shape, wherein the major axis 72 of the elliptical shape extends toward finger grips 68 and has a length greater than outside diameter of member 24 and the minor axis 76 has a length less than the outside diameter of the member. In its uncompressed state, resilient portion 64 grips member 24 along minor axis 76. However, when a user engages finger grips 68 and compresses resilient portion 64 therebetween, the elliptical shape is made more circular (as shown by dotted lines 80), causing major axis 72 to shorten and minor axis 76 to lengthen, thereby reducing, or releasing, the resilient portion's grip on member 24. While the user compresses resilient portion 64 in this manner, the user may readily move spotter 28 relative to member 24, or vice versa, from one location to another, e.g., from one indicia 44, 48 to another, along the length of the member.

In alternative embodiments, spotter 28 may include one or more rollers, cogs or other structures that allows the spotter to move along member 24. Correspondingly, member 24 may include one or more raceways, racks or other structures complementary to the structure(s) provided to body 52. In order to maintain the proper circumferential alignment of spotter 28 with member 24, body 52 may include one or more alignment structures, e.g., the spline structure shown that includes a spline 84 or other projection that slidably engages a groove 88 in member 24. Spline 84 may be on both non-resilient and resilient portions of body as shown, or only on one or the other portion as desired to suit a particular design. Of course, there are other sorts of complementary alignment structures possible, e.g., making member 24 and cavity 56 complementarily non-circular in cross-sectional shape, among others. Those skilled in the art will appreciate the broad scope of alignment structures that may be provided to device 20, such that an exhaustive list is not necessary herein for those skilled in the art to appreciate the broad scope of the invention.

Spotter 28 may also include one or more indicators 92 integral with or affixed to body 52 for indicating which indicia 44, 48 the spotter is presently indicating. In some embodiments, the number of indicators 92 may correspond to the number of sets 36, 40 of indicia. In some embodiments, it may be desirable to maintain the proper circumferential alignment of spotter 28 with member 24 so that the one or more indicators 92 properly align with the corresponding set(s) 36, 40 of indicia. In this case, body 52 and member 24 may include one or more complementary alignment structures, e.g., the spline(84)/groove (88) structures shown. In other embodiments, it may not be desirable to provide such alignment structure(s). For example, if spotter 28 includes one indicator 92, but member 24 includes two sets 36, 40 of indicia circumferentially spaced from one another, the spotter may be rotatable about longitudinal central axis 32 of member 24 so that the one indicator may be used to indicate any indicia 44, 48 in either of the two sets of indicia.

Indicator 92 may comprise an aperture 96 formed in body 52, a pointer (not shown), a bracketing structure (not shown) or a combination of these, among others. Indicator 92 may optionally include a magnifying lens 100, and spotter 28 may optionally include an illuminator 102, e.g., an LED, each for aiding a user in seeing the one of indicia 44, 48 at which the indicator is positioned. Lens 100 may have any magnification power desired or required, depending upon the size of indicia 44, 48.

Figure 2A:
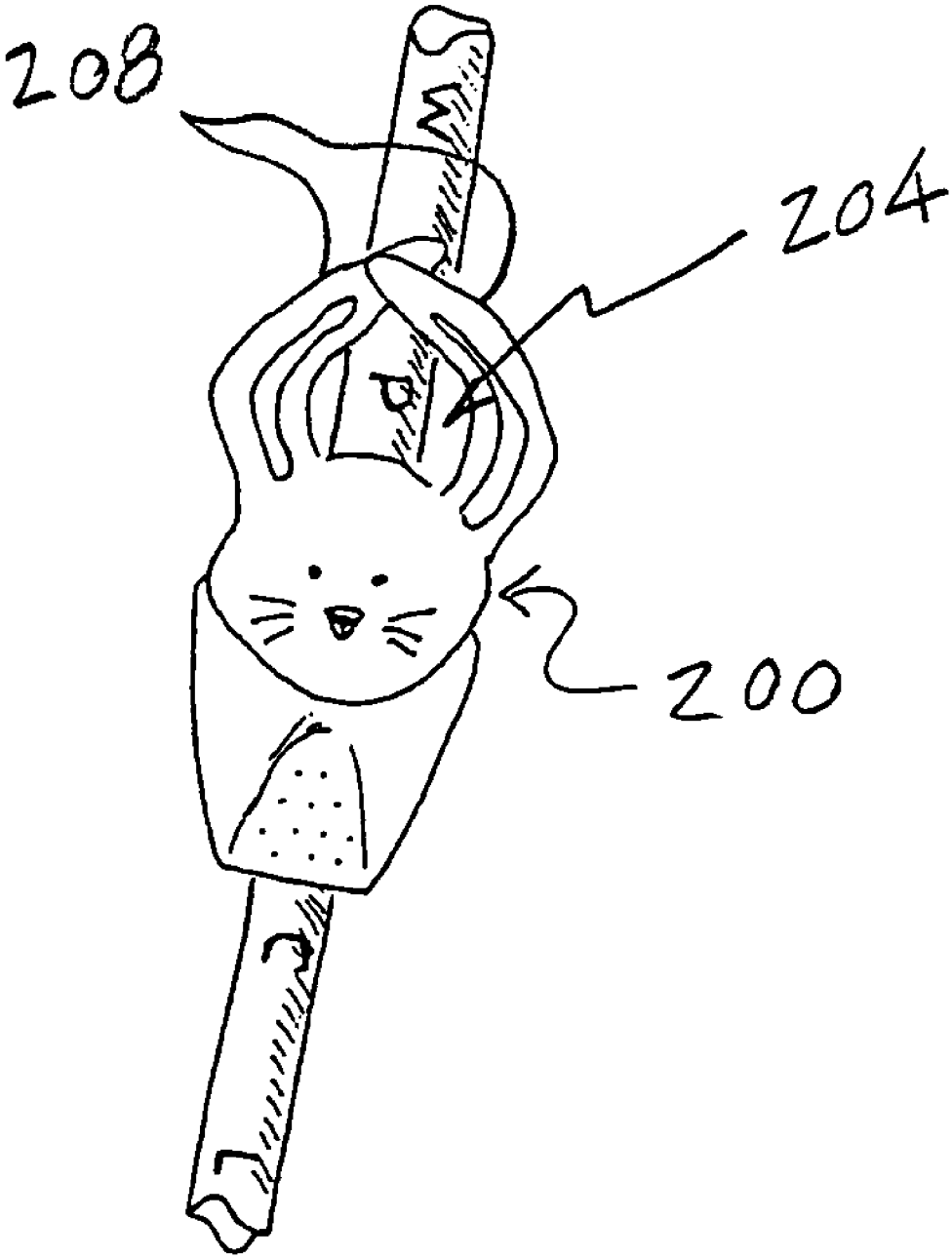
FIG. 2A is an enlarged plan view of an alternative spotter that may be used in place of the spotter of FIG. 1A.

FIG. 2A shows an alternative spotter 200 formed into the shape of a portion of an animal, in this case a rabbit. Indicator 204 is generally formed by the crossed ears 208. Of course, any animal or human, or portion thereof, may be incorporated into spotter 200. For example, such animals or humans could be characters, e.g., the well-known Bugs Bunny®, Mickey Mouse®, Snow White®, and Barbie® characters, licensed from the respective makers of children's movies, cartoons and toys, among other things. Alternatively, spotter 200, or portion thereof, may include the form of one or more inanimate objects as well, such as cars, trucks and buildings, among others.

Figure 2B:
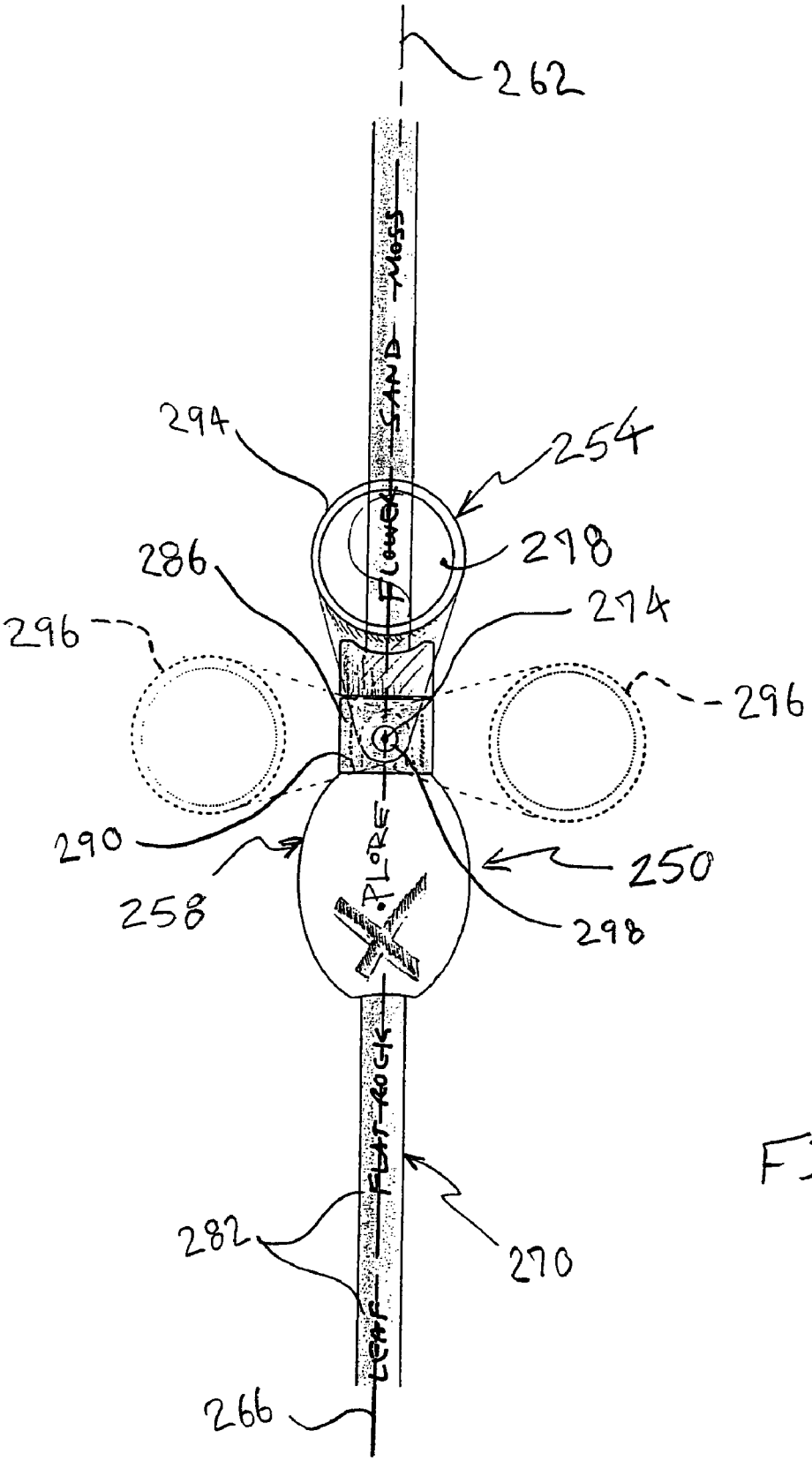
FIG. 2B is an enlarged plan view of another alternative spotter that may be used in place of the spotter of FIG. 1A.

FIG. 2B shows another alternative spotter 250. Spotter 250 comprises a body 258 and a magnifier/indicator 254 pivotably attached to the body so as to be pivotable about a first pivot axis 262 parallel to the longitudinal central axis 266 of member 270, but also about a second pivot axis 274 perpendicular to the longitudinal central axis of the member. Magnifier/indicator 254 may have a magnifying lens 278 of a power suitable for viewing indicia 282 on member 270 and/or other things, such as items spotted or anything a user desires to view through the magnifier/indicator. It may be desirable for magnifier/indicator 254 to be pivotable about first pivot axis 262 when member 270 comprises two or more sets of indicia 282 spaced from one another about the circumference of the member. In one embodiment (shown) this pivoting action may be accomplished using a collar 286 pivotably attached to body 258 so as to be pivotable about first pivot axis 262. Collar 286 may be made of any suitable material such as plastic, metal or relatively hard rubber, among others. Collar 286 may be pivotably engaged within a recess 290 formed in body 258.

Regarding second pivot axis 274, it may be desirable that magnifier/indicator 254 be pivotable about the second pivot axis so that the user may pivot it alternatingly between a first position 294 for viewing indicia 282 and a second position 296 for viewing spotted items (not shown) or anything else the user wishes to view. Magnifier/indicator 254 may be made pivotable about second pivot axis 274 in any suitable manner, such as the manner shown that includes a mechanical fastener 298, such as a rivet.

Referring again to FIG. 1A, each end of member 24 may include a corresponding end structure 104, 108. Each end structure 104, 108 may be provided for aesthetic reasons, to inhibit member 24 from being disengaged with spotter 28, to allow one end of the member to be connected to the other, to allow device 20 to be connected to a similar device, or any combination of these, among other things. In the embodiment shown, end structures 104, 108 are complementary male and female connectors that may be engaged with each other or with similar corresponding connectors, which may themselves be end structures of devices similar to device 20. When end structures 104, 108 are connectors, they may be any suitable type of connector, such as snap-fit, friction fit, magnetic, screw-type or interference fit, among others that those skilled in the art will recognize. End structures 104, 108 may be made of any suitable material, such as metal or plastic, among others, and may be attached to member in any suitable manner, e.g., crimping, adhesive bonding, heat or chemical welding, integral molding and/or mechanical fastening, among others.

As mentioned above, device 20 may be used to play spotting-type games wherein each player looks for items, e.g., objects, corresponding to each indicia 44, 48 in one or more sets 36, 40 of indicia. For example, in a simple game using one set 36 of indicia 44 and wherein the player must spot items in the order the indicia appear on member 24, the game may start with the player moving spotter 28 to the indicia 44 most proximate end structure 104. Set 36 of indicia 44 may comprise any number of things, such as letters of the alphabet, names of objects, words that characterize items, graphics depicting the items and/or alphanumerics indicating the items, among other things. In the example shown, indicia 44 are things that are typically readily spottable inside and around relatively small towns, e.g., a trash can, office building, barn, playground, etc.

The object of the game may be to spot all items in set 36, again, wherein the items must be spotted in the order appearing on member 24. For example, starting with spotter 28 indicating "Trash Can," the player must first spot a trash can. Once the player spots a trash can, the player may then moves spotter 28 (or member) so that indicator 92 indicates the next item that must be spotted, in the case of FIG. 1A, a "Fence." Once the player has moved spotter 28, the player must next spot a fence before moving the spotter again. The game may continue in a likewise fashion until the last letter of set 36 has been reached.

Alternatively, the game may continue, e.g., with the player needing to return spotter 28 to the first item of set 36 by stepping through the set in the opposite direction. If two or more players are playing with like devices, the game may turn competitive such that, e.g., the first player to reach one end or the other playing the game described above wins the game. As in conventional spotting games, additional rules may be instituted, such as that an item spotted by one player cannot be used by another player to advance his/her spotter 28 to the corresponding letter. Those skilled in the art will readily appreciate that many different games can be devised and played with device 20 and, further, that it is not practical to describe all such games, nor is it necessary to do so for those skilled in the art to understand the broad scope of the present invention. That said, FIG. 4 contains Tables 1–12 that show examples of various indicia 44, 48 that may be used for sets 36, 40 of indicia to play various games having particular themes 112. Of course, Tables 1–12 are merely illustrative and by no means indicate any sort of constraint on the types of indicia 44, 48 and themes 112 that may be incorporated into device 20.

Regarding themes 112, it is noted that the design of device 20 (FIG. 1A) and its theme(s) can be directed to particular travel destinations, such as countries, states/provinces, cities, amusement parks, movie studio parks and resorts, among others, or other subject matter. In this connection, the owner or representative of such a travel destination could commission the manufacture of a corresponding custom version of device 20 and sell these devices to their visitors. For example, personnel in charge of tourism for the city of New York could commission a version of device 20 having a spotter 28 configured like the Statue of Liberty and have indicia 44, 48 representing various famous buildings, locations and attractions found in New York City. A player could then "play the game" by visiting each of these items and moving spotter 28 accordingly. When spotter 28 is made in the likeness of a famous object, place, character or other thing, the spotter may generally be characterized as an "identifier" that identifies, among other things, a place where the thing is located or with which it is associated (e.g., the Empire State Building identifying New York City or Cinderella's Castle identifying Walt Disney World) or an activity associated with the thing (e.g., a paddle wheel boat identifying a Mississippi River cruise on that boat or an airplane identifying a trip by air), among other things.

Figure 3A:
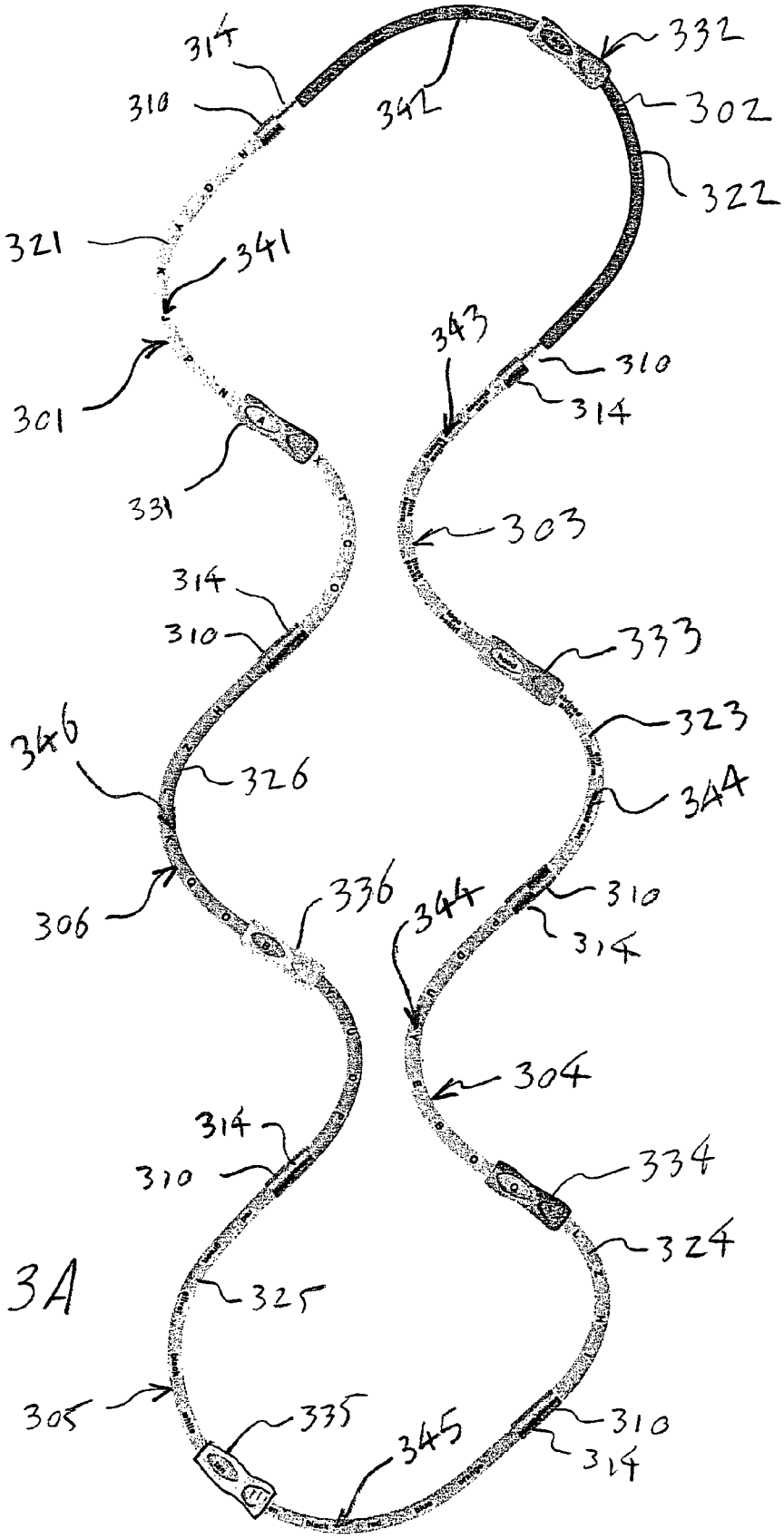
FIG. 3A is a plan view of a system of the present invention that includes a daisy chain of devices each similar to the device shown in FIG. 1A.

Referring to FIG. 3A, as mentioned above several devices, such as devices 301–306 that are each the same as or similar to device 20 of FIG. 1A, may be connected together to form a daisy chain using complementary connectors 310, 314 on the corresponding respective ends of members 321–326. Each device 301–306 may have its own spotter 331–336. All devices 301–306 may have one or more sets 341–346 of indicia having a common theme, or one or more of the devices may have themes different from the themes of others of the devices. As those skilled in the art will readily appreciate, chaining devices 301–306 together in this manner can greatly expand the number and character of games that may be played.

Figure 3B:
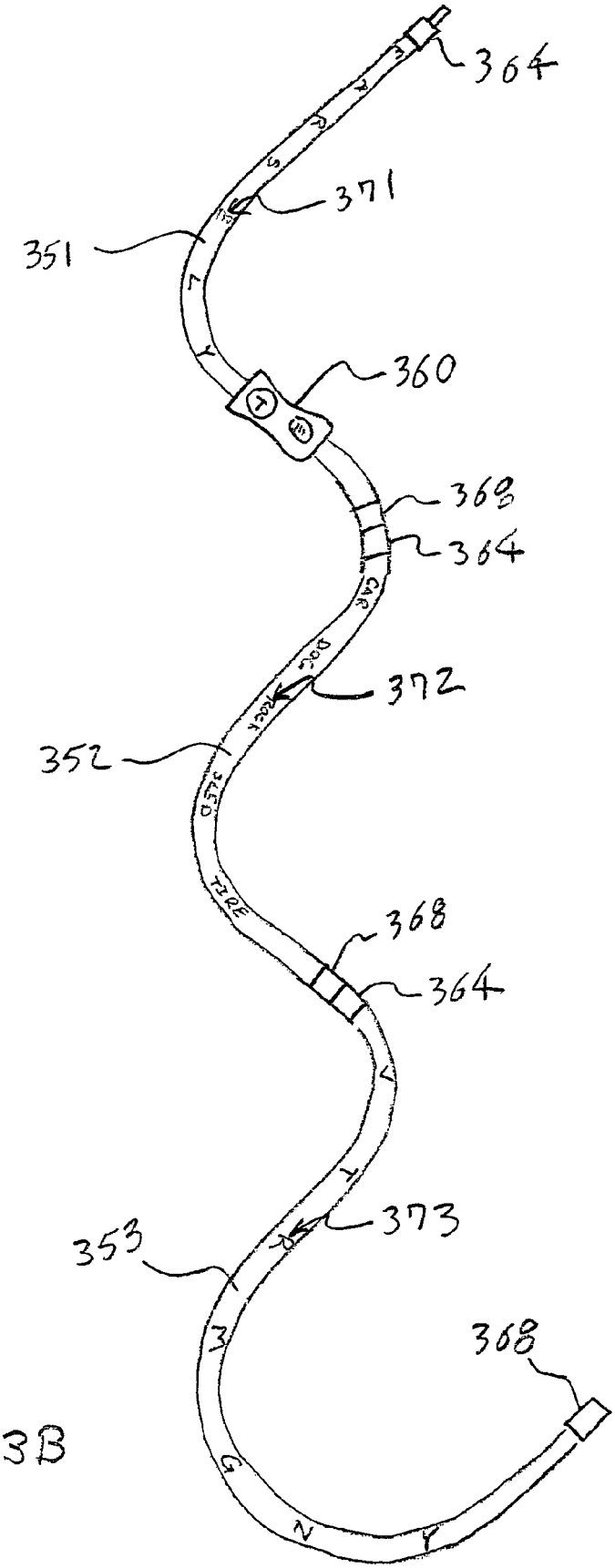
FIG. 3B is a plan view of an alternative system of the present invention that includes a daisy chain of members each similar to the member of the device shown in FIG. 1A.

Whereas FIG. 3A shows several devices 301–306 chained together, wherein each device includes its own spotter 331–336, as shown in FIG. 3B, in alternative embodiments several elongate members 351–353 may be chained together but share a common spotter 360 that is movable along each of the several members. In order to accommodate such an embodiment, connectors 364, 368 and/or spotter 360 may need to be modified relative to end structures 104 and spotter 28 shown in FIG. 1A. For example, connectors 364, 368 may be configured so that when connected, the outside diameter of the connection is identical, or nearly so, to the outside diameter of members 351–353. Similar to the embodiment shown FIG. 3A, all members 351–353 may have one or more sets 371–373 of indicia having a common theme, or one or more of the members may have a theme different from the themes of others of the members.

Figure 5:
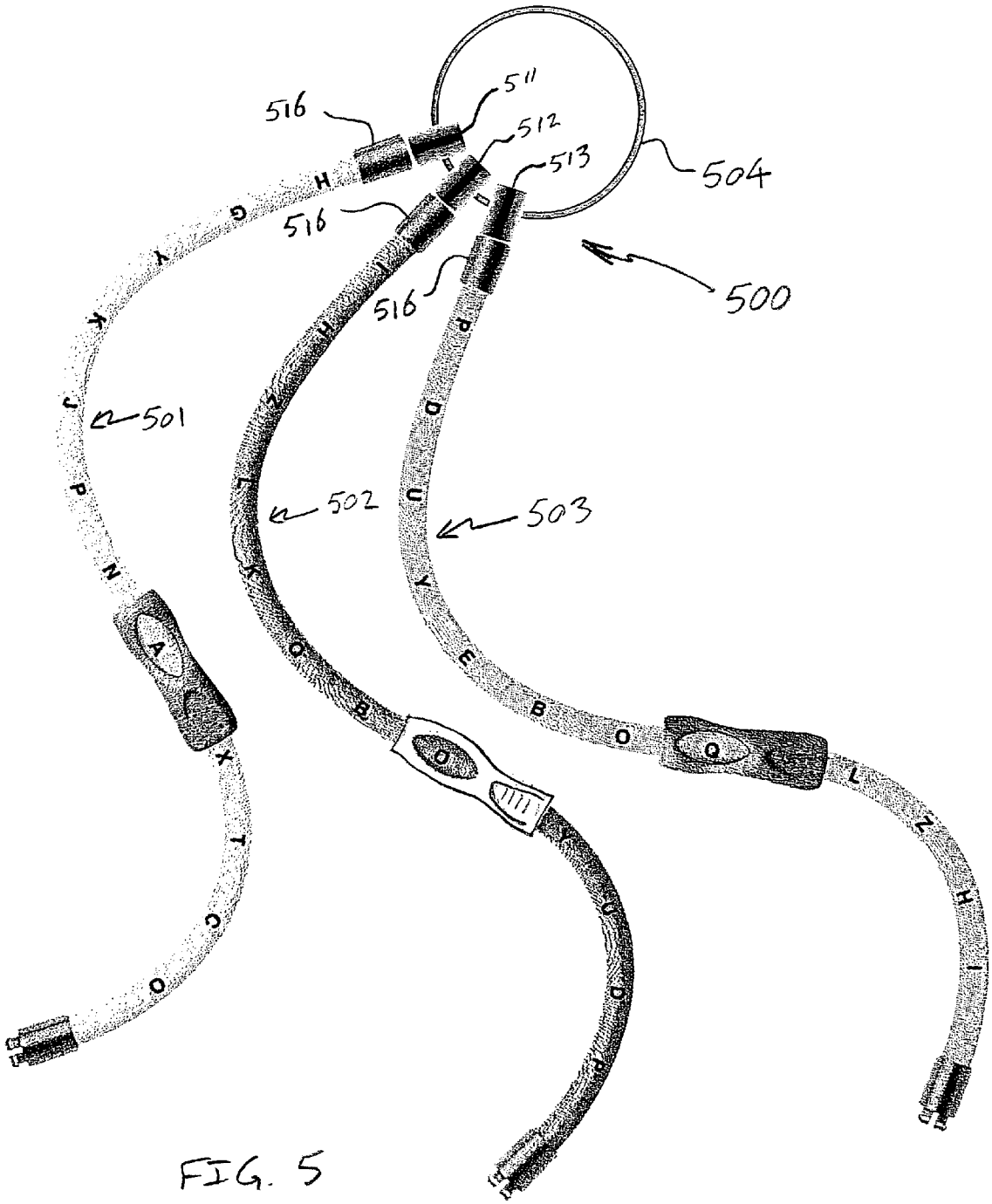
FIG. 5 is an elevational view of a holder of the present invention and a plurality of game devices similar to the game device of FIG. 1A attached thereto.

FIG. 5 shows a holder 500 that may be used to hold one or more devices 501–503, either during periods of play and/or non-play. Holder 500 may include a support 504, e.g., a ring or other structure, to which are movably and/or pivotably attached a plurality of receivers 511–513 for engaging each of devices 501–503 for securing that device to the support. In alternative embodiments (not shown), receivers 511–513 may be fixedly attached to support 504. When each device 501–503 includes at least one connector 516, such as end structure 108 of FIG. 1A, each receiver 511–513 may comprise the complementary connector. For example, if connectors 516 are female connectors, each receiver 511–513 may include a corresponding male connector. If devices 501–503 do not have connectors 516, each receiver 511–513 may have some sort of engagement member (not shown), e.g., a spring clip, that engages and holds a corresponding device. Regardless of whether receivers 511–513 are movable and/or pivotable relative to support 504 or whether the receivers are fixed relative to the support, those skilled in the art will appreciate that the design of the holder is generally constrained only by the imagination of the designer.

Figure 6:
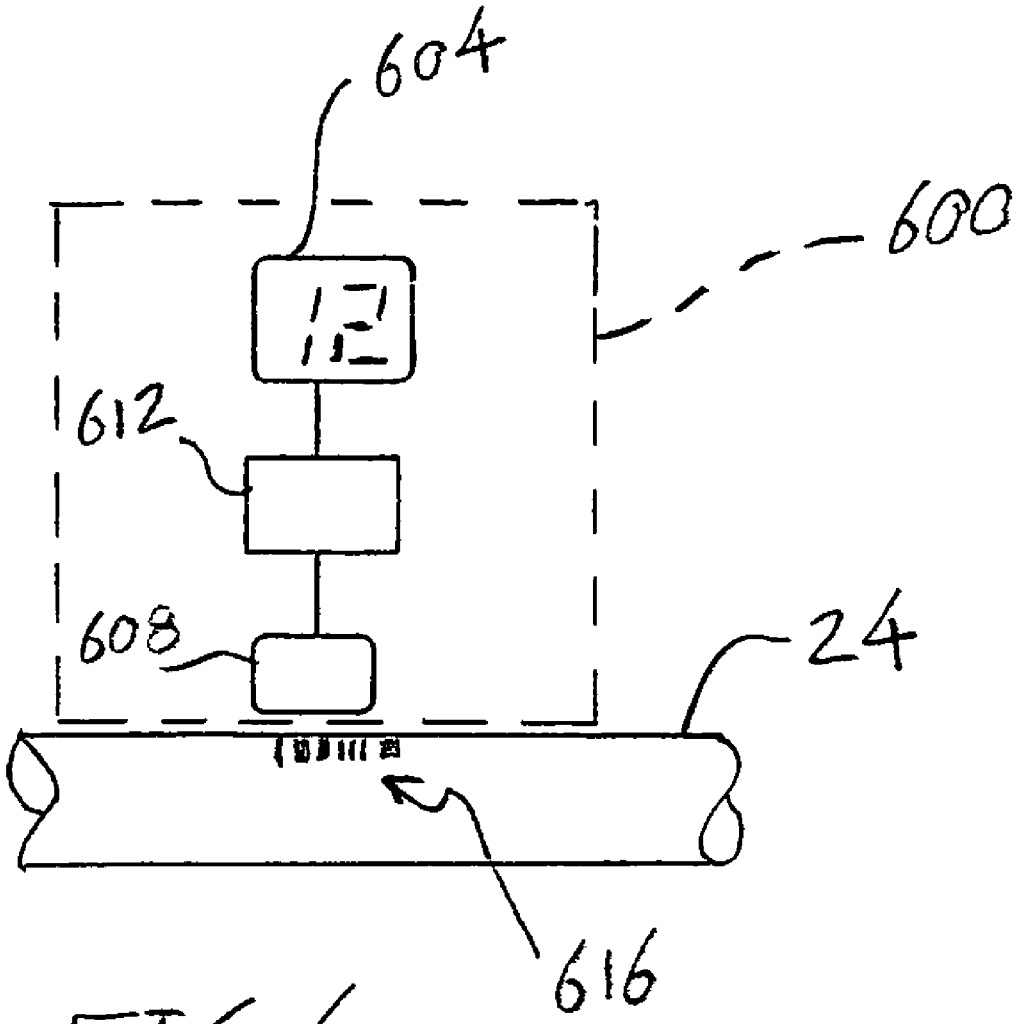
FIG. 6 is a high-level schematic diagram of a spotter of the present invention that includes an automatic tracking system.

Referring to FIG. 6, and also to FIG. 1A, FIG. 6 illustrates a tracking system 600 that may be incorporated into spotter 28 of device 20 of FIG. 1A. Tracking system 600 may be used to track, e.g., one or more of a number of points accumulated during a game, the order in which spotter 28 was moved from one indicia 44, 48 to another, the number of times the spotter was positioned at each indicia and/or elapsed time, either total or between moves of the spotter, among other things. Accordingly, tracking system 600 may include a display 604 for displaying the appropriate information to the player, a reader 608 for reading data corresponding to each indicia 44, 48 required for tracking and a computer 612 for processing input from the reader and controlling the display. Regarding reader 608, member 24 may be encoded with data corresponding to each indicia 44, 48. Such encoding may be accomplished in a variety of ways, such as incorporating the data into/onto member using barcode 616 or other optical storage, encoded surface texture or other mechanical storage, or magnetic storage, among others. Such data may include indicia 44, 48 itself, e.g., a letter, graphic or word, and a point value, if the various indicia have different point values. Tracking system 600 may be operatively configured to update itself automatically or, alternatively, manually, e.g., by the player pressing a button (not shown) on spotter 28. Those skilled in the art will understand the many ways that tracking system 600 may be configured and executed, such that an exhaustive list and an explanation of each is not necessary herein to enable those skilled in the art to practice the invention.

FIGS. 7A–7D illustrate an alternative device 700 of the present invention that may be used as a toy, as a learning device or to play a game, such as the game described above in connection with device 20 of FIG. 1A. Device 700 may include a support 704 and a member 708 removably engaging the support. Member 708 may include one or more sets 712 of indicia 716 in a manner similar to member 24 of FIG. 1A. Sets 712 of indicia 716 may have any theme, such as one of themes 112 discussed above in connection with FIG. 4. As particularly seen in FIGS. 7C and 7D, member 708 may be engaged with support 704, e.g., within a suitably shaped circumferential channel 720 extending at least partway around the circumference of the support. Channel 720 may be configured to correspond to the portion or portions of member 708 that the channel is intended to engage. In the embodiment shown, channel 720 has a generally circular transverse cross-sectional shape. In alternative embodiments, channel 720 may be located elsewhere on support 704, such as on its upper surface and may have another transverse cross-sectional shape, such as a shape that matches the shape of member 708.

Member 708 may be held in place relative to support 704 in any of a number of ways. For example, when channel 720 is present, the channel may be configured to define in transverse cross-section an arc somewhat greater than 180° such that member 708 must be snap-fit into the channel. Alternatively, channel 720 may have a rectangular shape with the distance between sidewalls being somewhat smaller than the outside diameter of member 708 such that the member is press-fit into the channel. In another alternative wherein member 708 has end connectors 724, 728 (FIG. 7D) similar to end structures 104, 108 discussed above in connection with FIG. 1A, support 704 may be provided with corresponding complementary receivers 732, 736 adjacent the ends of channel 720 for the connectors on the member to removably engage.

Figure 7D:
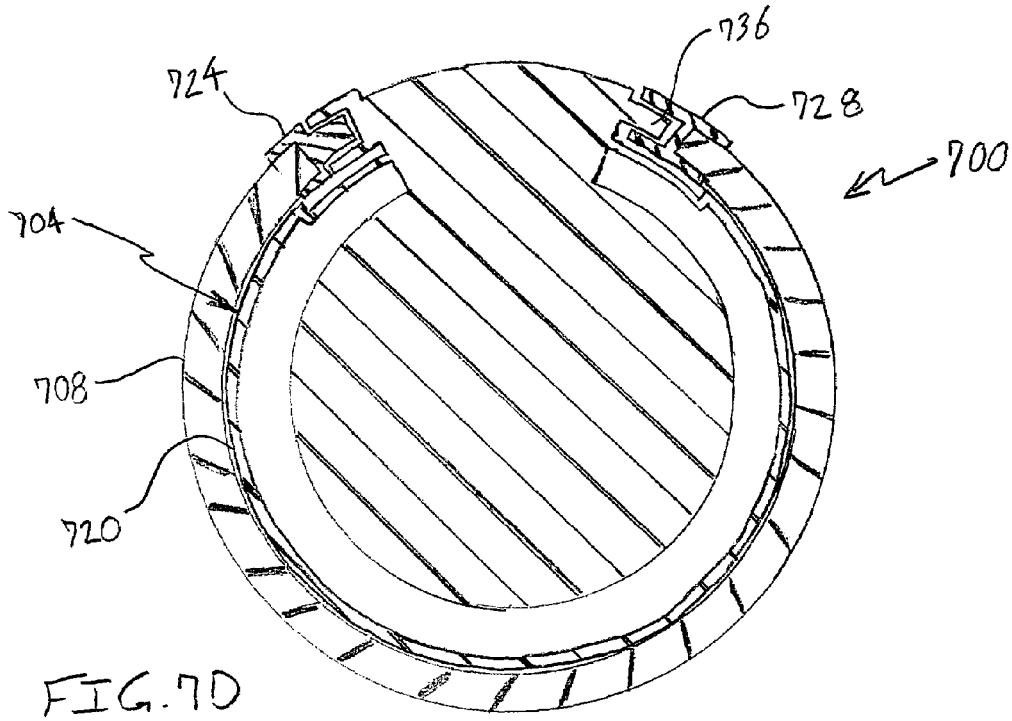
FIG. 7D is a cross-sectional view of the device of FIG. 7A as taken along the line 7D—7D of FIG. 7C.

Referring to FIGS. 7B and 7D, device 700 may further include a spotter 740 rotatatably engaged with support 704 so that the spotter and support may be rotated relative to one another. Spotter 740 may be used to indicate ones of indicia 716 of set 712 of indicia, in seriatim with one another. In this connection, spotter 740 may include an indicator 744, which in the embodiment shown is a magnifier 748 comprising a magnifying lens 752. Magnifier 748 may be pivotably mounted to a pair of brackets 756 or other structure so that magnifier 748 may be moved out of the user's line of sight if magnification is not desired. In other embodiments, indicator 744 may be separate from magnifier 748, e.g., the indicator may comprise a bracketing structure.

Referring to FIGS. 7A and 7D, support 704 or spotter 740 may optionally include a specimen holder 760 for holding a specimen (not shown) corresponding to any of indicia 716 on member 708. For example, specimen holder 760 may be a removable container removably engaged with a receptacle 764 in support 704. In the embodiment shown, specimen holder 760 is made entirely of a transparent material, e.g., plastic. In other embodiments specimen holder 760 may be only partly made of a transparent material, or not include any transparent material, e.g., where the holder has an opening through which a specimen contained therein is viewed.

Specimen holder 760 may, but need not, be used as follows. For example, if one of indicia 716 is "sand," the user of device 700 may place sand in specimen holder 760 for viewing. This feature can greatly add to the learning aspect of device 700, as the user can closely observe any one or more specimens in conjunction with spotting items corresponding to indicia 716. In an educational class setting, each student in the class may be provided with device 700 in which indicia 716 correspond, i.e., to items found in a local wooded area, such as moss, tree bark and snails, among other things. The students may then be allowed to roam the wooded area in order to find each of the items corresponding to indicia 716 on their device 700 (the indicia on one device may be the same as or different from the indicia on other devices so that the students are looking for different items). Each time a student spots an item corresponding to one of indicia 716, the student may place a specimen of that item into specimen holder 760 for observation. The student may optionally be required to write down qualities, characteristics or other information about each specimen before moving on to another item.

Figure 7C:
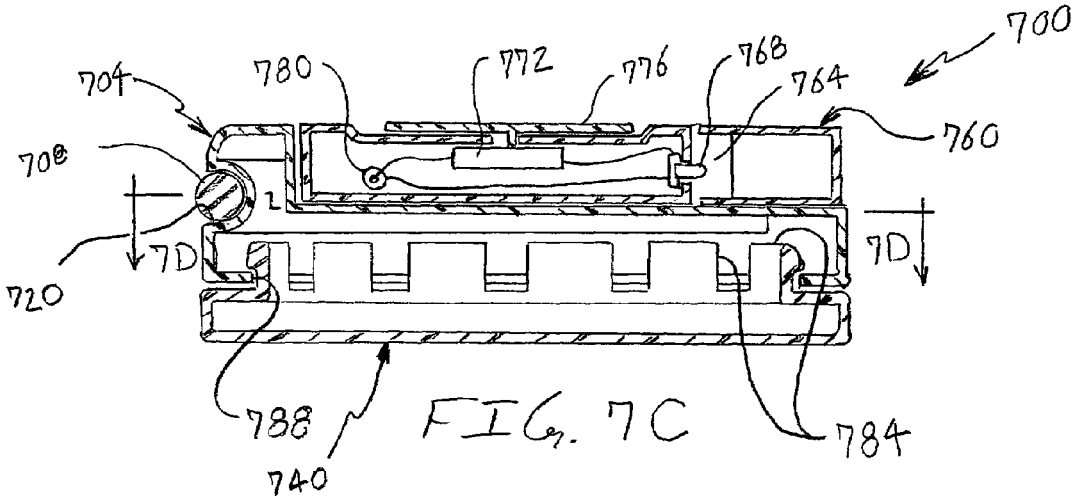
FIG. 7C is a cross-sectional view of the device of FIG. 7A as taken along the line 7C—7C.

Referring to FIGS. 7A and 7B, magnifier 748 and brackets 756 may be operatively configured to allow the user to pivot the magnifier into position over specimen holder 760 for magnifying the specimen contained therein. Depending upon ambient lighting conditions, as shown in FIG. 7C, it may be desirable to provide an illuminator 768 for illuminating the specimen in specimen holder 760. Illuminator 768 may be attached to support 704 and may be turned on and off Using a switch 772 having an actuator 776 located, e.g., on the upper surface of the support. Illuminator 768 may be powered by a battery 780 contained in support 704.

Support 704 and spotter 740 may be made of any suitable material or combination of materials, e.g., plastic, elastomer, metal, glass or wood, among others, or any combination of these. Support 704 and spotter 740 may be made rotatable relative to one another in any suitable manner, such as the sliding engagement of tabs 784 within an apertures 788 formed in the support. In other embodiments, the rotatability may be accomplished using other, perhaps more elaborate means, as will be apparent to those skilled in the art.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

What is claimed is:

1. A device, comprising:

a) an elongate resilient flexible member having a length and a longitudinal central axis and including at least a first set of indicia having a first plurality of indicia spaced from one another along said length; and b) a spotter engaged with said elongate resilient flexible member and movable so as to be positionable to indicate any selected one of said first plurality of indicia, said spotter including a magnifier pivotable about a first pivot axis substantially parallel to said longitudinal central axis.

2. A device according to claim 1, wherein said elongate flexible member has a circumference and further includes a second set of indicia spaced from said first set of indicia around said circumference.

3. A device according to claim 1, wherein said device is used in conjunction with spotting a plurality of items and said first plurality of indicia correspond to said plurality of items.

4. A device according to claim 1, wherein each one of said first plurality of indicia includes at least one graphic.

5. A device according to claim 1, wherein each one of said first plurality of indicia comprises at least one word.

6. A device according to claim 1, wherein said spotter comprises a cavity slidably receiving a portion of said member therethrough.

7. A device according to claim 6, wherein said spotter and said member comprise complementary alignment structures operatively configured to inhibit rotation of said spotter relative to said elongate flexible member.

8. A device according to claim 1, wherein said spotter comprises a resilient portion that releasably engages said member when said resilient portion is compressed.

9. A device according to cl aim 1, wherein said spotter further comprises an indicator operatively configured for indicating in seriatim ones of said first plurality of indicia.

10. A device according to claim 9, wherein said indicator comprises an aperture in said spotter.

11. A device according to claim 9, wherein said indicator comprises a magnifying lens.

12. A device according to claim 9, wherein said spotter further comprises an illuminator for illuminating the one of said first plurality of indicia indicated by said indicator.

13. A device according to claim 1, wherein at least a portion of said spotter comprises an identifier.

14. A device according to claim 13, wherein said identifier is a travel destination identifier.

15. A device according to claim 1, wherein at least a portion of said spotter is configured lice an animal or human.

16. A device according to claim 1, wherein said member includes a first end and a second end spaced from said first end and the device further includes a first end structure attached to said first end and a second end structure attached to said second end.

17. A device according to claim 16, wherein said first and second end structures are complementary connectors connectable to one another.

18. A device according to claim 1, wherein said magnifier is pivotable about a second pivot axis substantially perpendicular to said first pivot axis.

19. A device for use in conjunction with spotting a plurality of items, comprising:

a) an elongate member having a length and a longitudinal central axis and including at least a first set of indicia having a first plurality of indicia spaced from one another along said length, wherein said first plurality of indicia correspond to the plurality of items; and b) a spotter movable relative to said elongate member and movable so as to be positionable to indicate any selected one of said first plurality of indicia, said spotter including a magnifier pivotable about a first pivot axis substantially parallel to said longitudinal central axis.

20. A device according to claim 19, wherein said magnifier is pivotable about a second pivot axis substantially perpendicular to said first pivot axis.

* * * * *

UNITED STATES PATENT AND TRADEMARK OFFICE

CERTIFICATE OF CORRECTION

PATENT NO. : 7,118,106 B1
APPLICATION NO. : 10/775384
DATED : October 10, 2006
INVENTOR(S) : Steven W. Meyer and Karren E. Meyer It is certified that error appears in the above-identified patent and that said Letters Patent is hereby corrected as shown below:

Column 10, line 15, delete “cl aim 1” and insert -- claim 1 -- therefor.

Column 10, line 30, delete “lice” and insert -- like -- therefor.

Signed and Sealed this

Twentieth Day of November, 2007

JON W. DUDAS
*Director of the United States Patent and Trademark Office*